US005596879A

United States Patent [19]

Burkhart et al.

[11] Patent Number: 5,596,879

[45] Date of Patent: Jan. 28, 1997

[54] METHOD FOR DETERMINING OPTIMUM PLACEMENT OF REFRIGERANT LINE MUFFLER

[75] Inventors: Larry J. Burkhart, Indianapolis; Floyd B. Gant, Jr., E. Brownsburg; Kenneth W. Shearer; Mark D. Singer, both of Indianapolis, all of Ind.

[73] Assignee: Carrier Corporation, Syracuse, N.Y.

[21] Appl. No.: 317,862

[22] Filed: Oct. 4, 1994

[51] Int. Cl.[6] ..... F04B 39/00; F25D 19/00

[52] U.S. Cl. ..... 62/296; 415/119; 417/312

[58] Field of Search ..... 417/312; 62/296; 415/119; 181/212

[56] References Cited

U.S. PATENT DOCUMENTS 2,936,041 5/1960 Sharp et al. ..... 417/312 X 5,452,991 9/1995 Kita et al. ..... 417/312

FOREIGN PATENT DOCUMENTS 540459 5/1993 European Pat. Off. ..... 62/296

*Primary Examiner*—William E. Wayner

[57] ABSTRACT

A method for determining the optimum location for installing a muffler in a refrigerant line to reduce refrigerant line vibration caused by acoustical resonances. This method includes measuring the frequency of compressor discharge gas pulsations, ascertaining the speed of sound in the compressor discharge gas, calculating the wave length of the compressor discharge gas pulsation frequency, calculating a critical length, providing a refrigerant discharge line with a length equal to the calculated critical length to allow the formation of at least one standing wave in the discharge line, and installing a refrigerant line muffler in the refrigerant discharge line at a maximum of the standing wave.

9 Claims, 4 Drawing Sheets

METHOD FOR DETERMINING OPTIMUM PLACEMENT OF REFRIGERANT LINE MUFFLER

BACKGROUND OF THE INVENTION

1. Field of the Invention

This invention relates in general to controlling vibration and noise in heating and cooling systems and, in particular, to a method for reducing acoustical resonances in compressor discharge lines. More specifically, but without restriction to the particular embodiment hereinafter described in accordance with the best mode of practice, this invention relates to determining the optimum placement of a refrigerant line muffler to reduce suction and acoustical effects caused by formation of a standing wave in compressor suction and discharge lines.

2. Discussion of the Related Art

Prior research has identified three types of refrigerant line vibration. These include structural resonances, forced vibration, and acoustical resonances. Structural resonances result in refrigerant tubing systems when the frequency of the discharge gas pulsations exiting the system compressor is substantially equal to the natural frequency of the system tubing. Forced vibration occurring in refrigerant lines is attributed to compressor movement caused by compressor starts, stops, and continuing operation. Lastly, acoustical resonances are related to refrigerant tubing geometry and specific physical properties of the discharge gas.

It has previously been observed that standing waves caused by these acoustical resonances may form in the discharge line of a compressor employed in a heating or cooling system. Such standing waves contribute to the noise and vibration associated with operation of the system. In some instances, this vibration may be transferred to building ductwork, thereby driving the ductwork and other building elements which results in added system noise.

Established theory has been developed to predict a system critical length, which is a function of the frequency of the discharge gas pulsations, the speed of sound in the discharge gas, and the wavelength of the discharge gas pulsations. This theory holds that standing wave resonances will occur when the calculated critical length of a particular system matches the length of an element of tubing in the system. Under this theory, an element is defined as a segment of tubing between two terminations. Such terminations would include compressors, mufflers, sharp elbows, headers, or any other type of line equipment that causes a change in acoustic response.

Heat pumps are one type of heating and cooling system that have been identified as being subject to the undesirable noise effects of acoustical resonances. The typical heat pump system is comprised of five primary components of equipment including a compressor, a flow restriction valve (cooling and heating), reversing valve, and two heat exchangers. The heat exchangers are customarily referred to as the indoor and outdoor coils. The indoor coil is ordinarily positioned in the building structure within ductwork employed for directing the circulating room air. A fan is typically positioned adjacent to the indoor coil to induce the circulating air to flow over the coil and through the ductwork. The combination of the indoor coil and fan, and the enclosure which houses these components is commonly called the indoor unit. The compressor, the flow restriction valve, the reversing valve, and the second heat exchanger, which is commonly known as the outdoor coil, are typically contained within a single housing unit commonly called the outdoor unit, which is positioned on the exterior of the building structure to be heated or cooled. A fan is provided in the outdoor unit to induce heat exchange between the outdoor coil and the ambient air. These various heat pump elements are connected in a closed series loop by a system of tubing carrying a refrigerant. The direction of flow of refrigerant in the closed system is controlled by the reversing valve. This reversal of refrigerant flow direction allows the heat pump to be quickly switched between its cooling and heating cycles. It has recently been observed that acoustical resonances in heat pump systems occur principally during the heating cycle of the heat pump. The standing wave associated with these acoustical resonances begins formation in the compressor discharge line of the tubing system or network and is reflected through the tubing system between terminations. These acoustical resonances or disturbances can result in annoying low-pitched noise which is amplified by the indoor components of the system. Such components would include, for example, the indoor coil, the tubing kit, which connects the indoor unit to the outdoor unit, and any abutting house structure.

Prior methods for reducing the undesirable effects of acoustical resonances have involved attempting to design a refrigerant line system by avoiding elements of tubing having a length substantially equal to the calculated critical length for the particular system. These methods have resulted in limited success because standing wave patterns attempt formation regardless of element length. This partial formation of the standing wave also produces some degree of acoustical resonances and unwanted low-pitch noise. Other prior methods for reducing the effects of acoustical resonances in refrigerant lines have focused on installing a muffler as close as possible to the service valve or compressor while keeping them out of the critical ranges calculated for standing wave patterns. These methods have also met with moderate success for reasons not well understood prior hereto.

OBJECTS AND SUMMARY OF THE INVENTION

It is, therefore, an object of the present invention to improve heating and cooling systems.

Another object of this invention is to reduce noise and vibration associated with the suction discharge lines of a compressor utilized in a heating or cooling system.

It is a further object of the present invention to employ a critical length of tubing extending from the discharge of a compressor utilized in a heating or cooling system.

It is yet a further object of the present invention to allow the formation of a standing wave in the discharge line of a compressor.

Yet another object of the present invention is to identify the maximum point of a standing wave formed in the discharge line of a compressor.

An additional object of the present invention is to install a refrigerant muffler at the maximum point of a standing wave formed in the discharge line of a compressor.

Still another object of the present invention is to substantially eliminate acoustical resonances downstream from a muffler located at the maximum point of a standing wave formed in the discharge line of a compressor.

Yet a further object of the present invention is to utilize a critical length of tubing between the compressor discharge and the reversing valve in a heat pump to allow the formation of a standing wave therein.

Still an additional object of the present invention is to utilize a critical length of tubing between the compressor discharge and the reversing valve in a heat pump to allow the formation of a standing wave therein and to install a refrigerant muffler at the maximum point of the standing wave to substantially eliminate acoustical resonances downstream of the muffler.

These and other objects are attained in accordance with the present invention wherein there is provided a method for determining the optimum location for installing a muffler in a refrigerant line to reduce refrigerant line vibration caused by acoustical resonances. The refrigerant line forms the tubing system, which allows refrigerant to flow from the compressor to other system components in the line. The method according to this invention includes measuring the frequency of compressor discharge gas pulsations, ascertaining the speed of sound in the compressor discharge gas, calculating the wavelength of the compressor discharge gas pulsation frequency, calculating a critical length, providing a refrigerant discharge line with a length equal to the calculated critical length, thereby allowing the formation of at least one standing wave in the discharge line, and installing a refrigerant line muffler in the refrigerant discharge line at a maximum of the standing wave to thereby substantially eliminate acoustical resonances downstream from the muffler.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing, wherein.

DETAILED DESCRIPTION OF A PREFERRED EMBODIMENT

Figure 1:
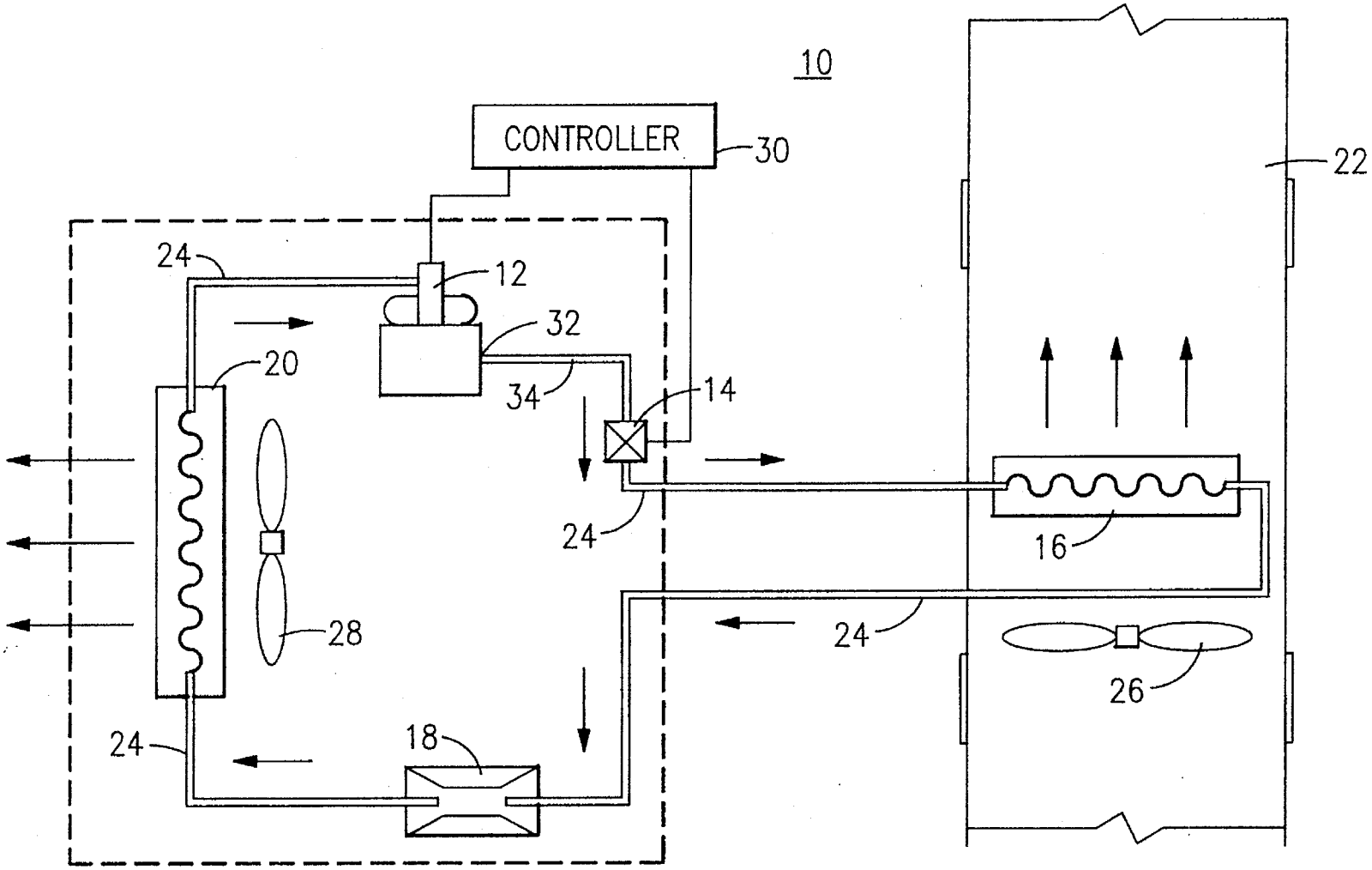
FIG. 1 is a partial schematic and pictorial representation of a heat pump which is a system amenable to the method of this invention.

Referring now to the drawing and initially to FIG. 1, there is shown a heat pump system generally referenced 10. Since the present discussion of this invention relates to the heating cycle of the illustrative heat pump system 10, operation of the heat pump's cooling cycle will be assumed without further description. The heat pump system 10 of FIG. 1 includes a compressor 12, a reversing valve 14, a first heat exchanger or indoor coil 16, a flow restriction valve 18, and a second heat exchanger or outdoor coil 20. The flow restriction valve 18 and the outdoor coil 20 are contained within a single housing unit positioned on the exterior of the building to be heated. The indoor coil 16 is positioned within the interior of the building structure to be heated within a heating duct 22. The compressor 12, reversing valve 14, indoor coil 16, flow restriction valve 18, and the outdoor coil 20 are connected by a closed refrigerant line 24, commonly known as a tubing kit or lineset, which is typically composed of copper tubing.

During the heating cycle of the heat pump system 10, the refrigerant contained in the refrigerant line 24 exits the compressor 12 in a vapor phase at a high temperature and pressure. The refrigerant then passes through the reversing valve 14 and into the indoor coil 16 where it is gradually cooled by the cooler circulating incoming room air as represented by the arrows in the heating duct 22. A main blower fan 26 is provided adjacent to the indoor coil 16 to induce the circulating room air through the indoor coil 16 for proper heat exchange between the refrigerant in the indoor coil 16 and the circulating room air. The refrigerant next exits the indoor coil 16 in a liquid phase at moderate temperature which is still under relatively high pressure. The liquid refrigerant is then directed through the refrigerant line 24 into the flow restriction valve 18 which provides a substantial local pressure drop in the refrigerant line 24 at that point. The refrigerant thereafter exits the flow restriction valve 18 in a mixed liquid and vapor phase at a much lower temperature and pressure. The mixed phase liquid and vapor refrigerant is then directed to the outdoor coil 20 where it absorbs some heat from the cold ambient air on the exterior of the building structure to be heated. An outdoor fan 28 is provided adjacent to the outdoor coil 20 to induce a flow of cold ambient air over the outdoor coil 20 to increase the rate of heat exchange between the circulating refrigerant and the cold ambient air. The refrigerant vapor then exits the outdoor coil 20 in the direction indicated by the arrows and enters the compressor 12 at which point the heating cycle begins again.

The compressor 12 and reversing valve 14 are controlled by a controller 30 which functions in conjunction with a room thermostat. The controller 30 maintains operation of the compressor 12 and electrically controls the reversing valve 14 to change the direction of refrigerant flow in the closed refrigerant line 24 when the heat pump 10 is switched from its heating cycle to its cooling cycle.

Acoustical resonances associated with the formation of standing waves originate in the discharge line of the compressor, which is the length of tubing between a compressor discharge port 32 of the compressor 12 and the reversing valve 14. Established theory predicts that standing waves associated with acoustical resonances in refrigerant line tubing will fully develop only in specific lengths or segments of tubing. These specific lengths for a particular heating or cooling system are known as the system critical length, which is a function of the frequency of the gas pulsations, the speed of sound in the discharge gas, and the wavelength of the discharge gas frequency. A particular system critical length is calculated by first measuring the frequency (f) of pulsations of compressor discharge gas occurring during operation of the compressor and ascertaining the speed of sound (C) in the compressor discharge gas. This frequency (f), also known as the system exciting frequency, is known to be 58 hertz for common scroll compressors operating at 3450 RPM when used in heat pumps. Common two cylinder reciprocating compressors operating at 3450 RPM, and four cylinder reciprocating compressor operating at 1750 RPM, have a 117 Hertz exciting frequency (f) which is twice or four times the compressor rotating speed, respectively. A wavelength ($\lambda$) for the compressor discharge gas pulsation frequency is then calculated according to the formula:

$$\lambda = C/f$$

where f is in hertz and C is in feet per second. The particular system critical length (cl) is then calculated in accordance with the formula:

$$cl = n(\lambda/2)$$

where n is any positive integer. When n is equal to one, the critical length is simply half of the wavelength (λ) for the compressor discharge gas pulsations, given a particular compressor exciting frequency (f). Any segment of discharge tubing having this calculated critical length, will allow the formation of a standing wave of substantially the same length within the length of tubing. When the element or segment length is doubled, i.e. where n equals two, a standing wave having a maxima and minima will form in the segment. As the element or segment length is increased therefrom, i.e. where n equals 3, 4, or 5 . . . , a standing wave having n maximum and minimum will form in the segment.

It is now understood that refrigerant line mufflers installed in lengths of discharge line tubing shorter than the calculated critical length for the particular system are ineffective in reducing acoustical disturbances because complete formation of a standing wave has been prevented. In discharge lines having a length longer than the minimum calculated system critical length, i.e. where n equals one, it is herein proposed that installing a muffler as close as possible to a system compressor or service valve is an ineffective method for reducing acoustical resonances because the muffler is not installed at the maximum point of the standing wave. Without regard to a calculated system critical length, this imprecise prior art method of muffler location may serve to prevent complete formation of a standing wave in the discharge line. In this type of non-quantitative solution, acoustical resonances of some degree may still occur and result in the undesirable production of noise.

The method of the present invention is derived from two principles which include: (1) the recognition that standing waves fully develop in critical lengths of discharge tubing, and (2) the presently proposed proposition that the noise effects caused by acoustical resonances can be substantially reduced by placing a refrigerant line muffler at a maximum of the standing wave. The preferred embodiment of the present invention contemplates locating the refrigerant line muffler at the first occurring maximum of the standing wave. The present preferred embodiment further contemplates providing a discharge line 34, between the compressor discharge 32 of compressor 12 and the reversing valve 14, with a critical length wherein n equals one so that only one crest of the standing wave forms therein and hence one maximum occurs within this length of tubing.

Figure 2:
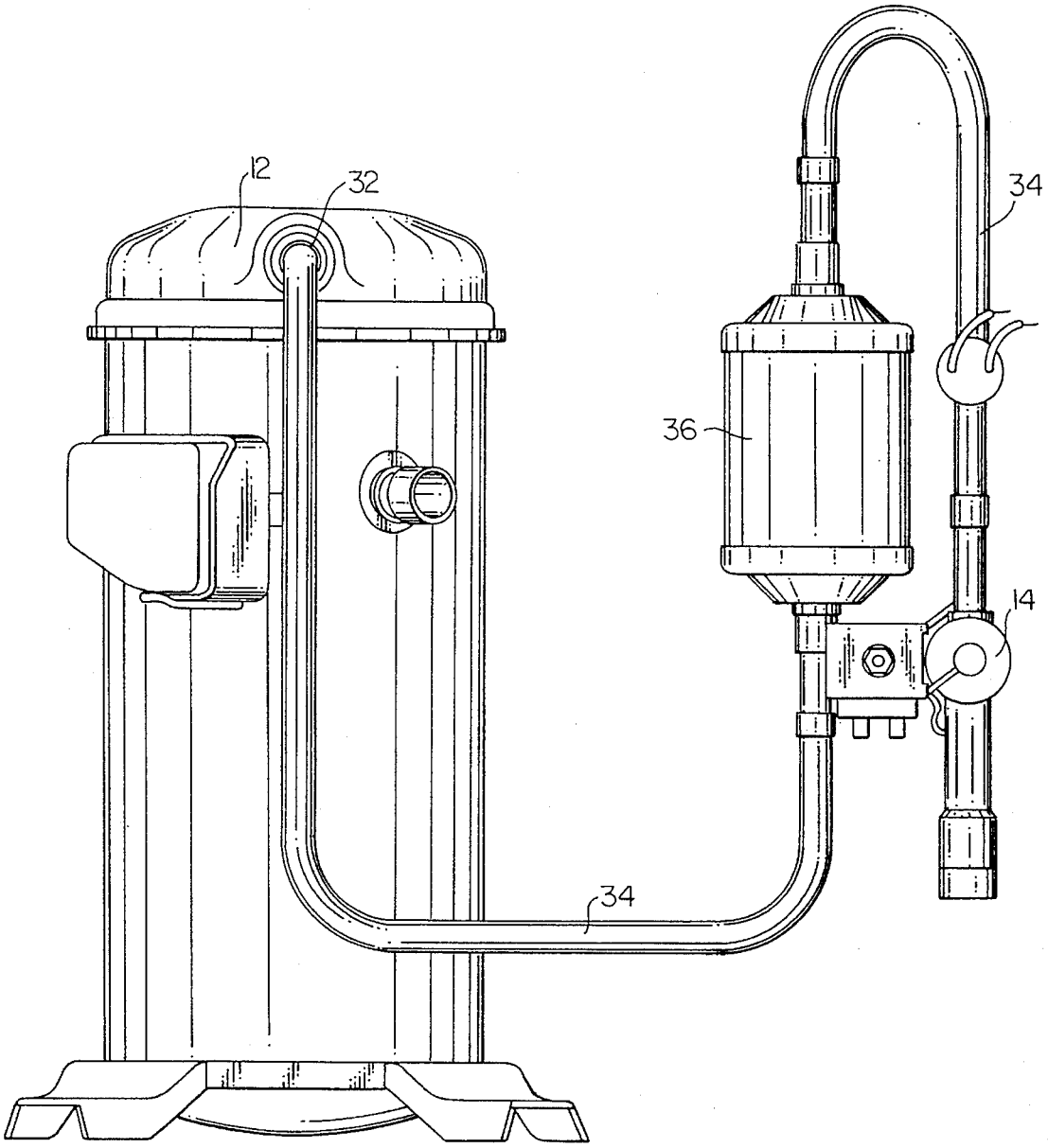
FIG. 2 is side elevation view of a compressor and discharge line illustrating location of a refrigerant line muffler in accordance with the method of the present invention.

With reference now to FIG. 2, it is illustrated that the preferred embodiment of the present method includes locating a refrigerant line muffler 36 halfway along the discharge line 34 which is provided with the critical length of λ/2, i.e., n is preferably equal to one. The following example, taken with reference to FIG. 2, illustrates calculation of a specific system critical length.

EXAMPLE

The heat pump system is a Carrier Corporation HVAC system. The system includes a compressor 12 which is a 3450 RPM scroll compressor lo having a once-per-revolution pulsation. This system compressor has a 58 hertz (Hz) pulsation frequency (f) in the refrigerant. The system refrigerant employed in this example was an R-22 refrigerant having a discharge pressure of 232 psi and a discharge temperature of 137° F. The sonic velocity (C) in this type of refrigerant, under the above physical conditions, is 544 ft/sec. This velocity is readily obtained from industry charts relating sonic velocity to discharge pressure and temperature for specific refrigerants. In accordance with the above identified standing wavelength formula:

$$\lambda = C/f$$

for this specific system example, $$\lambda = 544/58 = 9.37 \text{ ft} = 112.4 \text{ in.}$$

Fundamental acoustic theory requires that a minimum length of tubing equal to half the wavelength of the pulsation frequency exist in order for a standing wave to develop. In this system example, at least one full standing wave will occur if the length of discharge tubing between the compressor discharge 32 and the reversing valve 14 is approximately 56 inches or any multiple thereof. In the preferred embodiment of this example shown in FIG. 2, the discharge line 34 is provided with a length of half the wavelength λ or approximately 56 inches to reduce cost of tubing and minimize space requirements. In this length of discharge tubing, the maximum of the standing wave will occur at the midpoint, i.e. at approximately 28 inches from the compressor discharge 32. For optimum damping effect, the muffler 36 is located at the first wave maximum which resides at the quarter wavelength point, approximately 28 inches from the compressor discharge 32.

Figure 3:
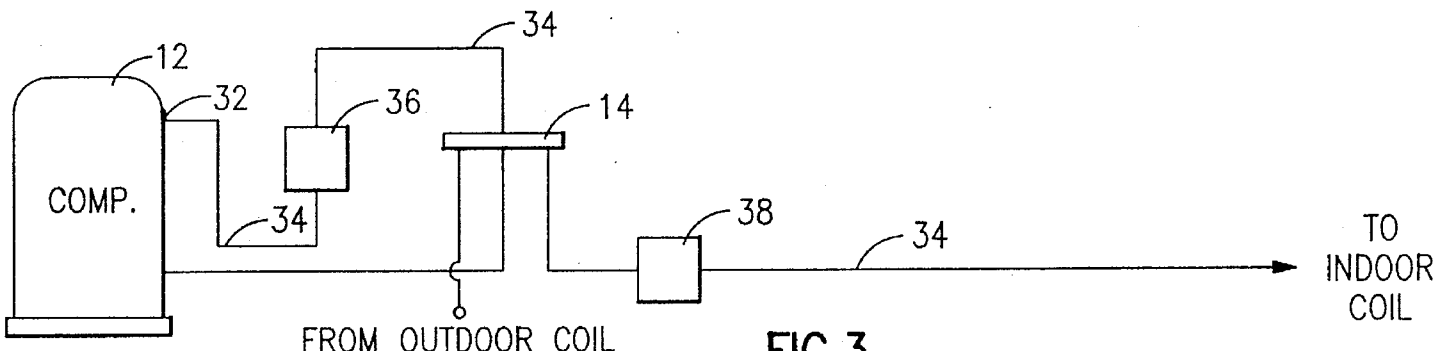
FIG. 3 is a schematic representation of a compressor and discharge line having a muffler located in accordance with the present invention.

FIG. 3 is a schematic representation of a compressor 12 and discharge line 34 including a reversing valve 14 and a muffler 36 positioned in accordance with the method of the present invention. FIG. 3 also shows a vapor service valve 38 which is employed to service the system through the discharge line 34.

Figure 4:
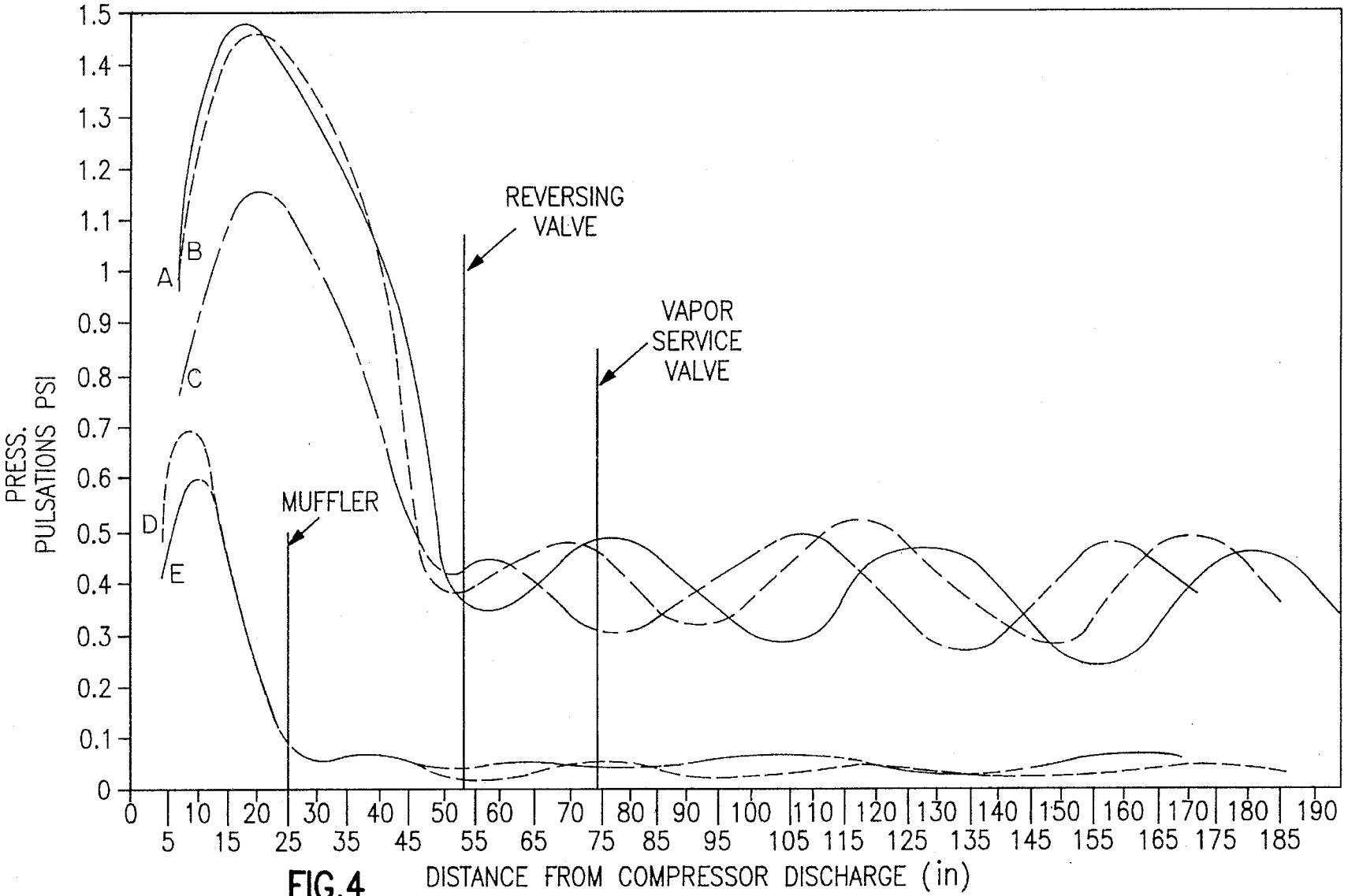
FIG. 4 is a graphic illustration comparing system pressure pulsations in the discharge and vapor lines in systems without a muffler to a system with a muffler installed according to this invention.

Several systems were tested and analyzed in development of the method of the present invention. FIG. 4 is a graphical representation illustrating the relationship between pressure pulsations and distance from the compressor discharge for five different test heating/cooling systems, each of the different systems being identified as A through E. The graph of FIG. 4 describes the pressure pulsation amplitudes as measured at 5 to 7 inch intervals along the refrigerant line discharge tubing 34 for each of the five different systems. The horizontal axis of the graph represents distance from the compressor discharge 32 along the axis of the discharge line 34, and the vertical axis represents pulsation amplitude. It has been observed that the higher the pulsation amplitude, the greater the annoyance to occupants of the building structure containing the system. Industry experience has documented that systems with pulsation amplitudes above approximately 0.3 psi are likely to produce consumer complaints. All of the systems A to E represented in the graph have a reversing valve 14 located at the system critical length. The average system critical length for these systems was approximately 54 inches as shown in the graph of FIG. 4. Systems A, B, and C did not include a muffler and thus exhibited a maximum pressure pulsation about 1.5 psi and an average vapor line pulsation of approximately 0.5 psi downstream of the reversing valve 14. Systems D and E include a discharge line muffler 36 located in accordance with the present method. As indicated by the graph of FIG. 4, systems D and E experience less than a 0.7 psi maximum pressure pulsation in the short distance before the muffler 36 and an average of less than 0.1 psi for the entire length of discharge tubing downstream of the muffler 36.

Figure 5:
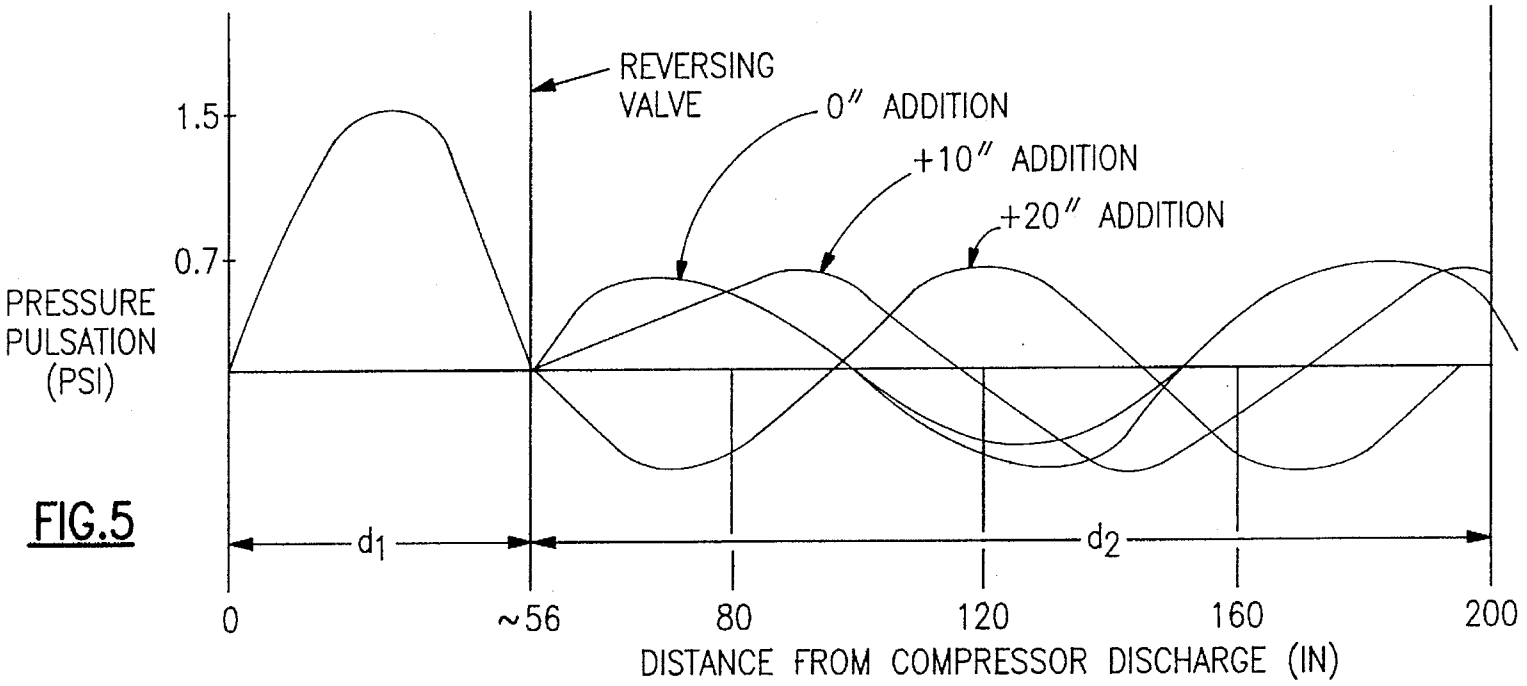
FIG. 5 is a composite graphic representation employed to illustrate the effect of small changes in the length of the tubing kit on the location of the standing wave maximum.

The graph of FIG. 5 is a composite representation of systems A to C discussed in conjunction with FIGS. 3 and 4. FIG. 5 serves to illustrate the difficulty in attempting to resolve pulsation noise problems by arbitrarily placing a muffler within the interconnecting lineset. The tubing distance or length between the compressor discharge 32 and the reversing valve 14 is identified as $d_1$ while the tubing distance between the reversing valve 14 and the indoor coil 16 is identified as $d_2$. When the length of $d_1$ is significantly less than the calculated system critical length, location of a muffler in this region is not effective in reducing acoustical noise effects because the standing wave does not become fully established. Location of a refrigerant line muffler in the region of $d_2$ in accordance with prior art methods has met with limited success because the peak of the standing wave changes location with small changes in tube length in the region of $d_2$. As illustrated in the graph of FIG. 5, an addition of 10 inches of tubing length causes a significant shift in the peak of the standing wave. Thus, the preferred embodiment of the present method is to locate the muffler 36 at the maximum of the standing wave caused to form in the region of $d_1$. In accordance with the present invention $d_1$ is given a fixed length equal to the calculated system critical length in manufacturing the system. In retrofit installations according to the method of the present invention, control of the length of the $d_1$ region is substantially more practical than attempting to locate a wave peak in the region of $d_2$.

While this invention has been described in detail with reference to a preferred embodiment utilized in conjunction with a heat pump compressor, it should be appreciated that the present invention is not limited to that precise embodiment. Rather, the present invention is contemplated for use in a wide variety of heating and cooling systems including scroll or reciprocating compressors. Therefore, in view of the present disclosure which describes the current best mode for practicing the invention, many modifications and variations would present themselves to those of skill in the art without departing from the scope and spirit of this invention, as defined in the following claims.

What is claimed is:

1. A method for determining the optimum location for installing a muffler in a refrigerant line to reduce refrigerant line vibration caused by acoustical resonances, the refrigerant line forming the tubing system in a heating or cooling system including a compressor, said method comprising the steps of:

measuring the frequency (f) of pulsations of compressor discharge gas occurring during operation of the compressor;

ascertaining the speed of sound (C) in the compressor discharge gas;

calculating the wavelength (λ) of the compressor discharge gas pulsation frequency (f) according to the formula:

$$\lambda=C/f$$

calculating a critical length (cl) according to the formula:

$$cl=n(\lambda/2)$$

where n is a positive integer;

providing a refrigerant discharge line with a length of n(λ/2) between the compressor discharge and a first termination point downstream of the compressor discharge, said providing step thereby allowing the formation of at least one standing wave in the discharge line, said refrigerant discharge line being a segment within the tubing system; and installing a refrigerant line muffler in the refrigerant discharge line at a distance n(λ/4) from the compressor discharge to thereby substantially eliminate acoustical resonances downstream from the muffler.

2. The method according to claim 1 wherein said heating or cooling system is a heat pump system operating during its heating cycle, said first termination point downstream of said compressor discharge is a reversing valve, and the variable n has a value of one.

3. The method according to claim 1 wherein said compressor is a scroll type compressor.

4. The method according to claim 1 wherein said compressor is a reciprocating type compressor.

5. A method for determining the optimum location for installing a muffler in a refrigerant line to reduce refrigerant line vibration caused by acoustical resonances, a segment of the refrigerant line forming the discharge line in a heat pump system between a compressor and a reversing valve of the system, said method comprising the steps of:

measuring the frequency (f) of pulsations of compressor discharge gas occurring during heat cycle operation of the compressor;

ascertaining the speed of sound (C) in the compressor discharge gas;

calculating the wavelength (λ) of the compressor discharge gas pulsation frequency (f) according to the formula:

$$\lambda=C/f$$

calculating a critical length (cl) according to the formula:

$$cl=n(\lambda/2)$$

where n is a positive integer;

providing the refrigerant discharge line with a length of n(λ/2) thereby allowing the formation of at least one standing wave in the discharge line; and installing a refrigerant line muffler in the refrigerant discharge line at a distance n(λ/4) from the compressor discharge to thereby substantially eliminate acoustical resonances downstream from the muffler.

6. The method according to claim 5 wherein the variable n has a value of one.

7. The method according to claim 5 wherein said compressor is a scroll type compressor.

8. The method according to claim 5 wherein said compressor is a reciprocating type compressor.

9. A method for determining the optimum location for installing a muffler in a refrigerant line to reduce refrigerant line vibration caused by acoustical resonances, the refrigerant line forming the tubing system in a heating or cooling system including a compressor, said method comprising the steps of:

measuring the frequency (f) of pulsations of compressor discharge gas occurring during operation of the compressor;

ascertaining the speed of sound (C) in the compressor discharge gas;

calculating the wavelength (λ) of the compressor discharge gas pulsation frequency (f) according to the formula:

$$\lambda=C/f$$

calculating a critical length (cl) according to the formula:

$$cl=\lambda/2$$

providing a refrigerant discharge line with the critical length of $\lambda/2$, between the compressor discharge and a first termination point downstream of the compressor discharge, said providing step thereby allowing the formation of a standing wave in the discharge line, said refrigerant discharge line being a segment within the tubing system; and installing a refrigerant line muffler in the refrigerant discharge line at a maximum of the standing wave, said maximum being approximately located at a distance $\lambda/4$ from the compressor discharge, to thereby substantially eliminate acoustical resonances downstream from the muffler.

* * * * *